US011384753B1

(12) United States Patent
Sanford

(10) Patent No.: US 11,384,753 B1
(45) Date of Patent: Jul. 12, 2022

(54) GAS OPERATED UNLOADER VALVE

(71) Applicant: DRESSER-RAND COMPANY, Houston, TX (US)

(72) Inventor: Joel T. Sanford, Bath, NY (US)

(73) Assignee: DRESSER-RAND COMPANY, Houston, TX (US)

( * ) Notice: Subject to any disclaimer, the term of this patent is extended or adjusted under 35 U.S.C. 154(b) by 0 days.

(21) Appl. No.: 17/314,138

(22) Filed: May 7, 2021

(51) Int. Cl.

| | |
|---|---|
| ***F04B 49/06*** | (2006.01) |
| ***F04B 49/24*** | (2006.01) |
| ***F04B 7/04*** | (2006.01) |
| ***F04B 7/00*** | (2006.01) |
| ***F04B 49/22*** | (2006.01) |
| ***F04B 7/02*** | (2006.01) |
| ***F04B 39/08*** | (2006.01) |

(52) U.S. Cl.
CPC ..... *F04B 49/06* (2013.01); *F04B 7/0092* (2013.01); *F04B 7/02* (2013.01); *F04B 7/04* (2013.01); *F04B 39/08* (2013.01); *F04B 49/225* (2013.01); *F04B 49/24* (2013.01)

(58) Field of Classification Search
CPC .. F04B 7/02; F04B 7/04; F04B 7/0092; F04B 49/06; F04B 49/225; F04B 39/08
See application file for complete search history.

(56) References Cited

U.S. PATENT DOCUMENTS 5,139,051 A * 8/1992 Walstad ..... F04B 49/02 137/630
3,070,461 A1 12/2011 Sanford
8,070,461 B2 * 12/2011 Sanford ..... F04B 39/08 417/306
8,308,455 B2 * 11/2012 Wallis ..... F04B 49/225 417/446
9,309,978 B2 4/2016 Hatch et al.
9,562,527 B2 * 2/2017 Spiegl ..... F04B 49/03
10,781,806 B2 9/2020 Hatch et al.
11,015,591 B2 5/2021 Sanford
2014/0294619 A1 10/2014 Mangiagli

FOREIGN PATENT DOCUMENTS

WO 2020251530 A1 12/2020

* cited by examiner

*Primary Examiner* — Patrick Hamo

(57) ABSTRACT

An unloader valve includes a seat including a plurality of inlet apertures spaced apart from one another and extending through the seat along one of a plurality of parallel inlet axes. A manifold plate is fixedly connected to the seat and includes a plurality of outlet apertures, each spaced apart from one another and extending through the manifold plate along one of a plurality of parallel outlet axes. The unloader valve also includes a plurality of plug holes, a control chamber formed in the manifold plate, and a control space fully defined by the manifold plate and arranged to fluidly connect the control chamber and each of the plug holes to one another. The unloader valve also includes a control member disposed within the control chamber and movable between a first position in which the control space is exposed to a pressure source, and a second position in which the control space is isolated and a plurality of plugs, each positioned within one of the plug holes and movable between a closed position in which each plug closes one of the inlet apertures and an open position in which the plurality of inlet openings are in fluid communication with the plurality of outlet openings.

21 Claims, 9 Drawing Sheets

GAS OPERATED UNLOADER VALVE

BACKGROUND

Gas compressors and in particular reciprocating gas compressors often include an unloader valve that controls the flow of gas to be compressed into the compressor. Due to flow and operating constraints, these unloader valves often include a number of smaller valves that are each opened and closed simultaneously. A complex mechanical system performs the actuation and is controlled or driven by a separate electric, hydraulic, or pneumatic system. These separate systems can be costly to operate and maintain and add significant complexity to the gas compression system employing the reciprocating gas compressor.

BRIEF SUMMARY

In one aspect, an unloader valve includes a seat including a plurality of inlet apertures, each inlet aperture spaced apart from the other inlet apertures and extending through the seat along one of a plurality of parallel inlet axes. A manifold plate is fixedly connected to the seat and includes a plurality of outlet apertures, each spaced apart from the other outlet apertures and extending through the manifold plate along one of a plurality of parallel outlet axes. The unloader valve also includes a plurality of blind plug holes, each centrally aligned along one of the plurality of parallel inlet axes, a control chamber formed in the manifold plate, and a control space fully defined by the manifold plate and arranged to fluidly connect the control chamber and each of the blind plug holes to one another. The unloader valve also includes a control member disposed within the control chamber and movable between a first position in which the control space is exposed to a pressure source, and a second position in which the control space is isolated and a plurality of plugs, each plug positioned within one of the blind plug holes and movable between a closed position in which each plug closes one of the inlet apertures and an open position in which the plurality of inlet openings are in fluid communication with the plurality of outlet openings.

In another aspect, an unloader valve for use with a reciprocating gas compressor having a compression space defined by a piston and a cylinder includes a seat including a plurality of inlet apertures, and a manifold plate fixedly connected to the seat. The manifold plate includes a plurality of outlet apertures, a plurality of plug holes, a control chamber formed in the manifold plate, and a control space fully defined by the manifold plate and arranged to fluidly connect the control chamber and each of the plug holes to one another. The unloader valve also includes a control member disposed within the control chamber and movable between a first position in which the control space is exposed to the compression space, and a second position in which the control space is isolated from the compression space. The unloader valve for use also includes a plurality of plugs, each plug positioned within one of the plug holes, each plug movable from a closed position in which each plug closes one of the inlet apertures to an open position in response to the control member being disposed in the first position and a pressure within the control space being below a predetermined pressure, and where each plug is maintained in the open position in response to the control member being in the second position.

In another aspect, an unloader valve for use with a reciprocating gas compressor having a compression space defined by a piston and a cylinder includes a seat including a plurality of inlet apertures, a manifold plate including a plurality of outlet apertures and a plurality of attachment apertures, a control seat threadably coupled to the manifold plate to fixedly attach the seat and the manifold plate, and an interface plate positioned between the seat and the manifold plate and cooperating with the manifold plate to define a control space. A plurality of valve cups are arranged with each valve cup threadably connected to the manifold plate and operable to sandwich the interface plate between the valve cups and the manifold plate. A control member is disposed within the control seat and is movable between a first position in which the control space is exposed to the compression space, and a second position in which the control space is isolated from the compression space. A plurality of plugs is arranged with each plug positioned within one of the valve cups and movable from a closed position in which each plug closes one of the inlet apertures to an open position in response to the control member being disposed in the first position and a pressure within the control space being below a predetermined pressure, and where each plug is maintained in the open position in response to the control member being in the second position.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

As used herein, the terms "component" and "system" are intended to encompass hardware, software, or a combination of hardware and software. Thus, for example, a system or component may be a process, a process executing on a processor, or a processor. Additionally, a component or system may be localized on a single device or distributed across several devices.

Further the phrase "at least one" before an element (e.g., a processor) that is configured to carry out more than one function/process may correspond to one or more elements (e.g., processors) that each carry out the functions/processes and may also correspond to two or more of the elements (e.g., processors) that respectively carry out different ones of the one or more different functions/processes Also, it should be understood that the words or phrases used herein should be construed broadly, unless expressly limited in some examples. For example, the terms "include" and "comprise," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise.

Figure 1:
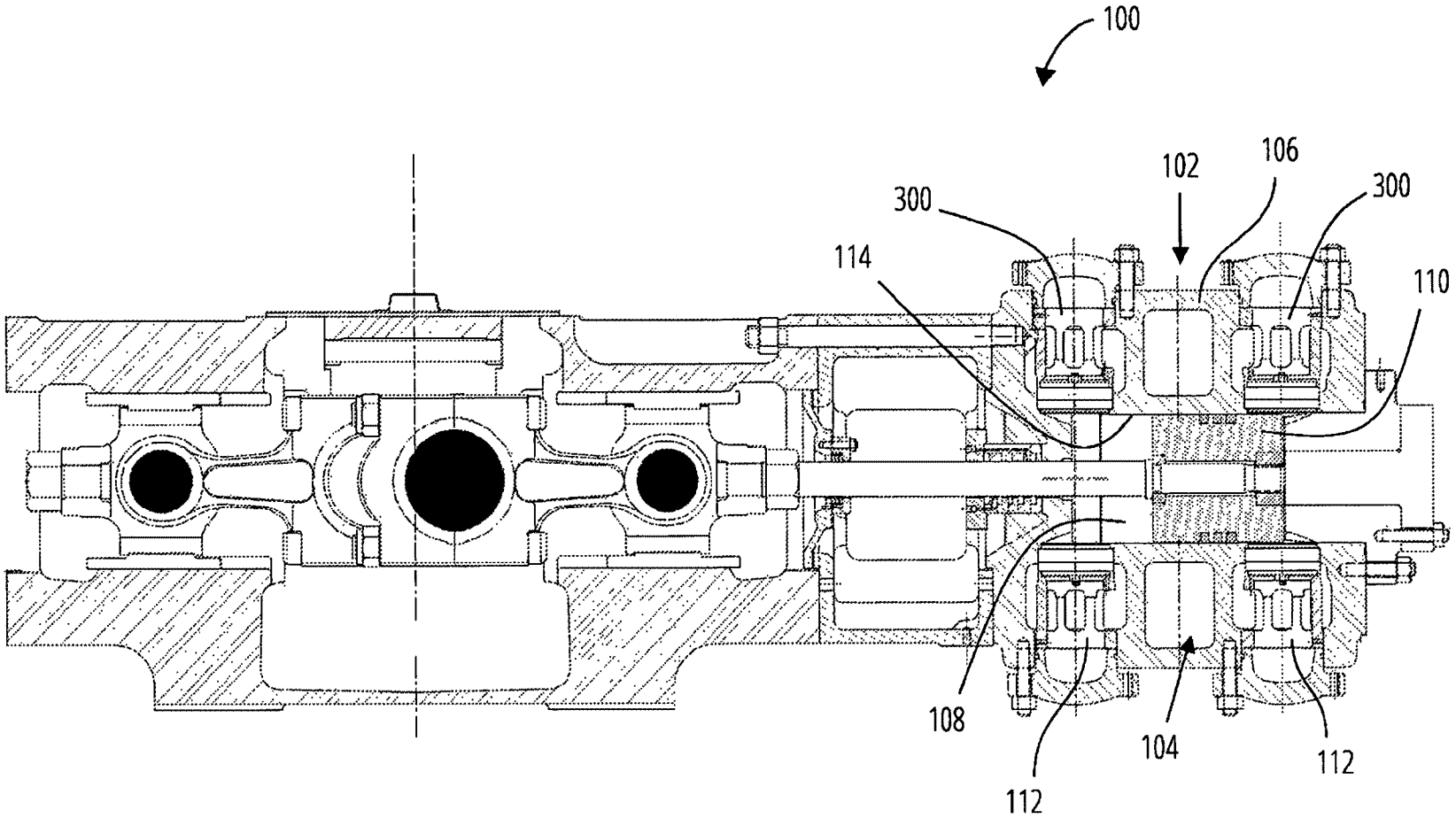
FIG. 1 is a section view of a portion of a reciprocating gas compressor.

FIG. 1 illustrates a portion of a reciprocating gas compressor 100 that is driven by a prime mover, such as an electric motor or other engine to produce a compressed gas. The reciprocating gas compressor 100 includes one or more casings 106 that each define a cylinder 114 that supports a piston 110 for reciprocating movement. The piston 110 and the casing 106 cooperate to define a compression space 108 that has a volume that various with the reciprocating motion of the piston 110 to draw in gas to be compressed and to compress the gas as is well known.

A gas inlet 102 is provided in the casing 106 to receive a supply of gas to be compressed and a gas outlet 104 is formed in the casing to collect the compressed gas produced by the reciprocating gas compressor 100. As will be discussed in greater detail, a number of unloader valves 300 are coupled to the casing 106 and are positioned between the gas inlet 102 and the compression space 108 to control the admission of uncompressed gas into the compression space 108. Similarly, a number of discharge valves 112 are provided between the compression space 108 and the gas outlet 104 to control the outflow of compressed gas.

Figure 2:
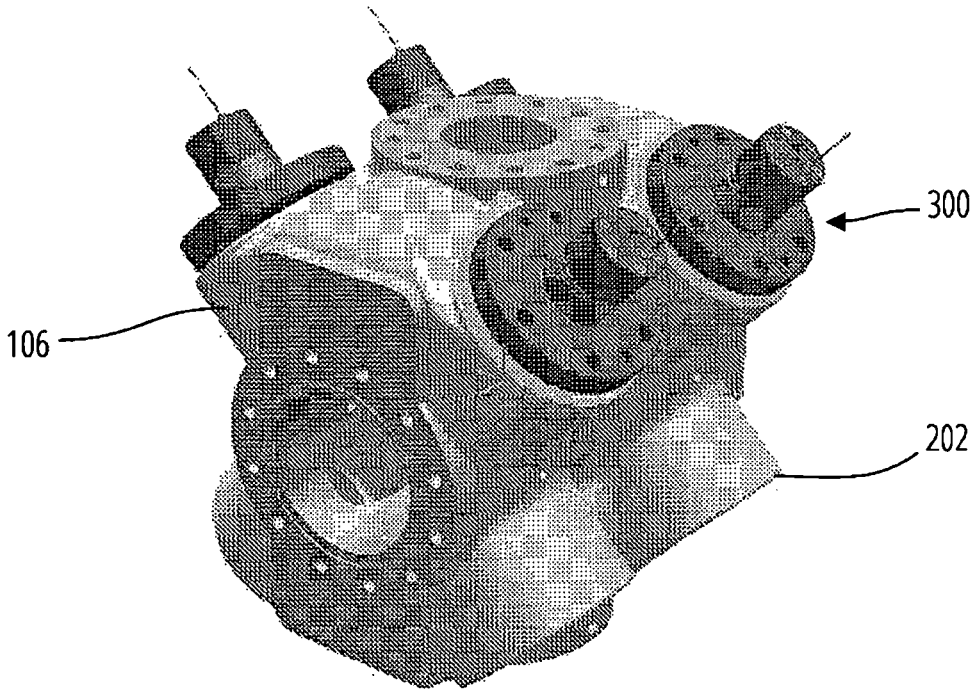
FIG. 2 is a perspective view of a portion of the reciprocating gas compressor of FIG. 1 including an unloader valve.

FIG. 2 illustrates a portion of the reciprocating gas compressor 100 that includes the casing 106 and defines a number of inlet/outlet bores 202. One unloader valve 300 is attached to each of four of the inlet/outlet bores 202 with four discharge valves 112 (not shown) attached to the remaining four inlet/outlet bores 202. Of course, other arrangements could have more or fewer unloader valves 300 and discharge valves 112 as may be required for the particular design.

Figure 3:
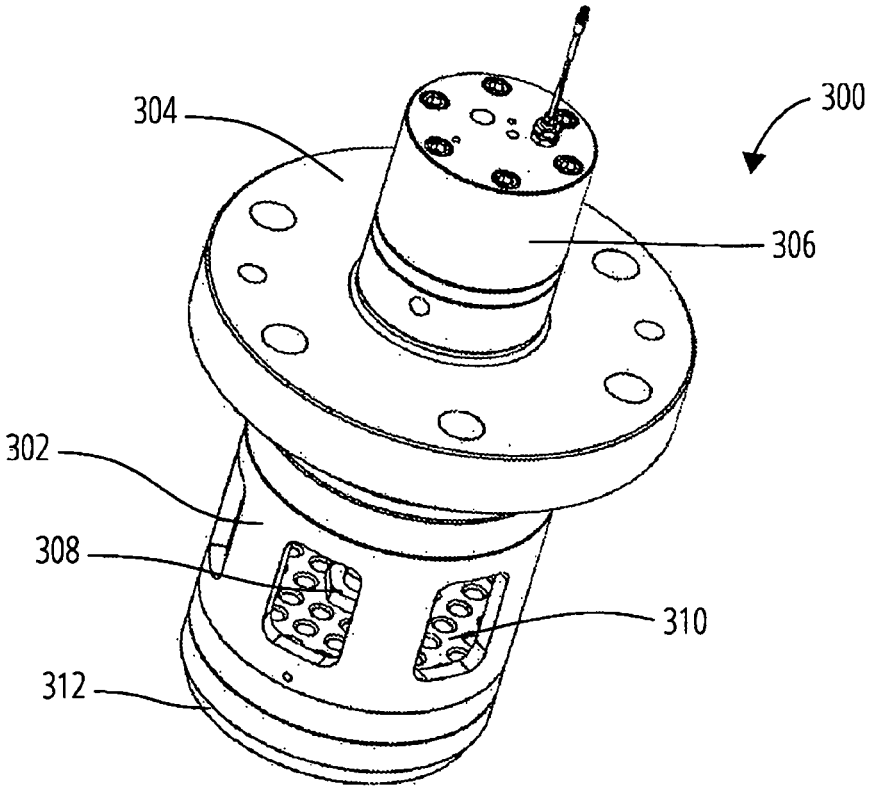
FIG. 3 is a perspective view of the unloader valve of FIG. 2.

FIG. 3 illustrates one of the unloader valves 300 of FIG. 2 with all the unloader valves 300 being substantially the same. The unloader valve 300 includes a valve housing 302 that supports the remaining components in their desired operating positions and a flange 304 that is arranged to facilitate the attachment of the unloader valve 300 to the casing 106. In the illustrated construction, the flange 304 includes a plurality of apertures arranged to receive fasteners that attach the unloader valve 300 to the casing 106.

An actuator 306 is positioned adjacent the flange in a position that ultimately is outside of the casing 106 during operation. As will be discussed in greater detail, the actuator 306 can be an electrical, hydraulic, pneumatic or any other type of actuator desired. A control member 308 (better illustrated in FIG. 4) is coupled to the actuator 306 for movement as will be discussed in greater detail.

The unloader valve 300 also includes a seat 310 and a manifold plate 312 positioned at one end of the valve housing 302 such that when the unloader valve 300 is attached to the casing 106 in its operating position, the manifold plate 312 is positioned nearest to the piston 110.

Figure 4:
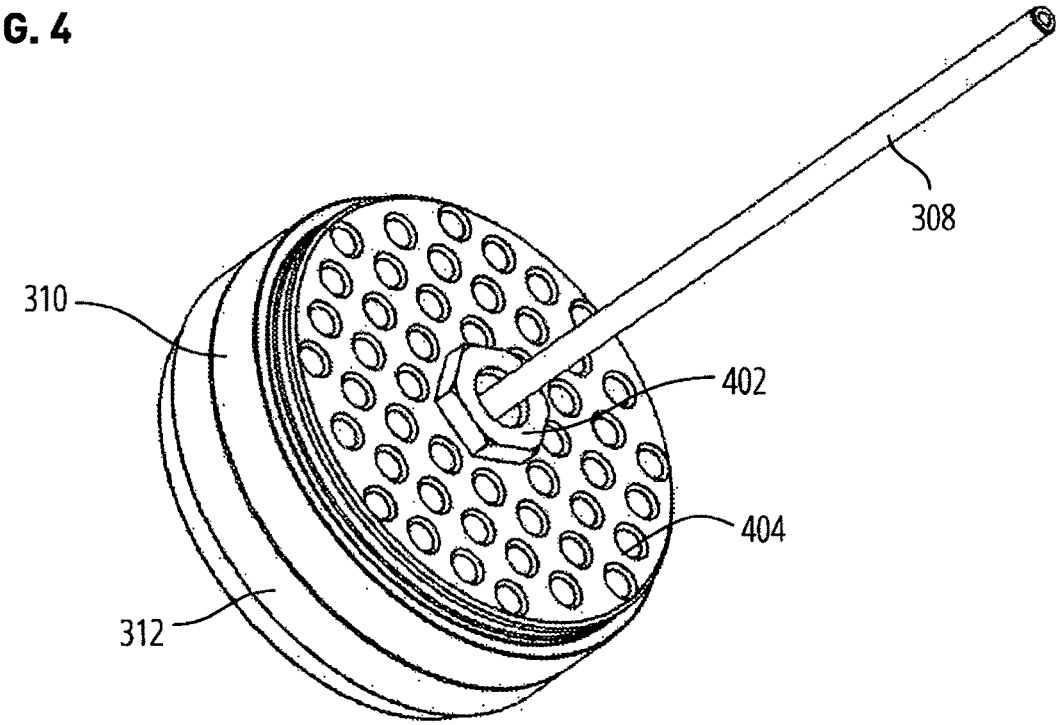
FIG. 4 is a perspective view of a portion of the unloader valve of FIG. 3.

FIG. 4 illustrates the manifold plate 312, the seat 310, and the control member 308 with the remainder of the unloader valve 300 omitted. The control member 308 includes an elongated shaft that extends from the seat 310 to a position within the actuator 306 to allow the actuator 306 to move the control member 308 between a first position and a second position. A control seat 402 is coupled to one of the seat 310 and the manifold plate 312 and cooperates with the control member 308 during operation of the control member 308.

The seat 310 includes a plurality of inlet apertures 404 with each inlet aperture 404 passing through the seat 310. The inlet apertures 404 are arranged in a series of rows and columns with other arrangements being possible. In the illustrated construction, forty-eight inlet apertures 404 are employed with typical applications including twenty or more. Of course, any suitable number of inlet apertures 404 could be employed as required.

Figure 6:
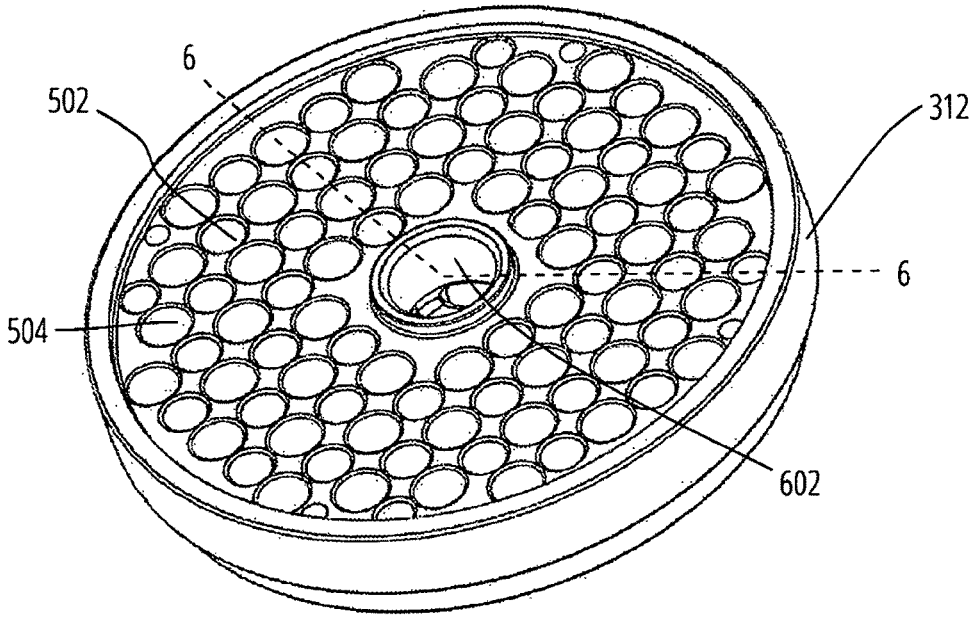
FIG. 6 is a perspective view of a manifold plate of the unloader valve of FIG. 4.
Figure 7:
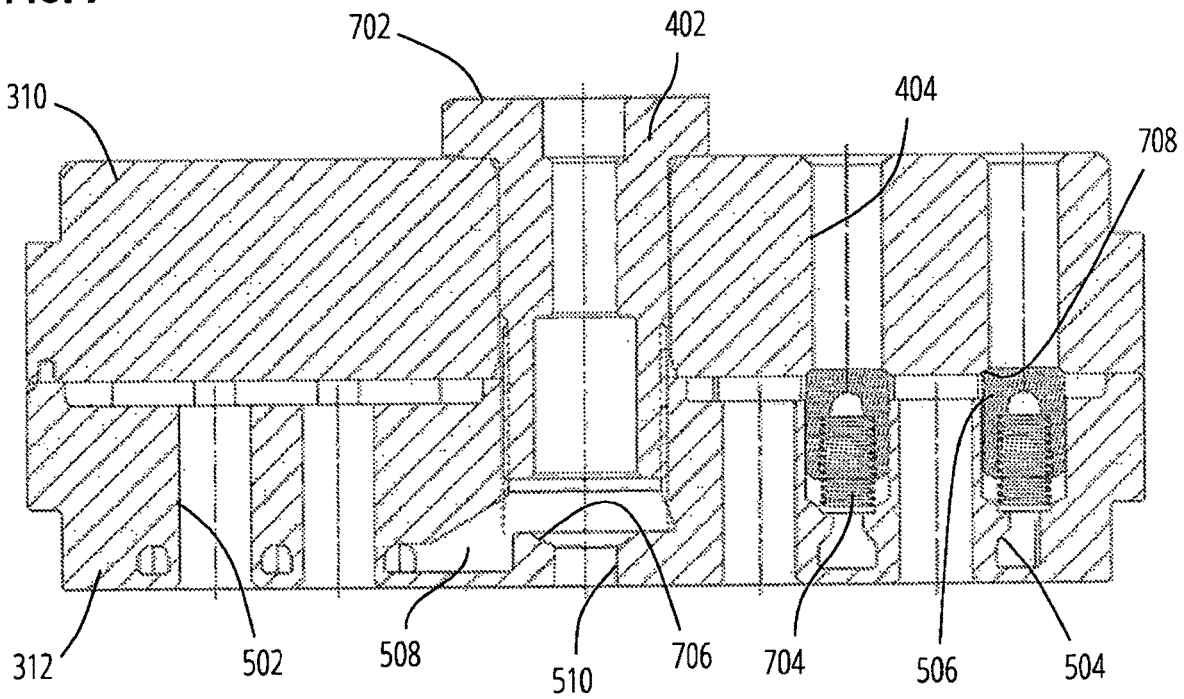
FIG. 7 is a cross-sectional view of the unloader valve of FIG. 4 taken along line 6-6 of FIG. 6.

FIG. 6 illustrates one possible embodiment of a manifold plate 312. In the illustrated construction, the manifold plate 312 includes a central bore 602, a series of outlet apertures 502, and a series of plug bores 504. The central bore 602 is sized to receive the control seat 402 which, as illustrated in FIG. 7 also serves to attach the seat 310 to the manifold plate 312. Specifically, the control seat 402 threadably engages the manifold plate 312 and includes a collar 702 that retains the seat 310 in the desired position.

The outlet apertures 502 and the plug bores 504 are arranged adjacent one another in a series of rows and columns. With this arrangement, each outlet aperture 502 is most closely surrounded by four plug bores 504. Similarly, each plug bore 504 is most closely surrounded by four outlet apertures 502. Each of the plug bores 504 is aligned with and coaxial with an inlet aperture 404 of the seat 310 while the outlet apertures 502 are arranged parallel to the inlet apertures 404 but are offset or misaligned.

FIG. 7 is a section view taken through the rows or columns described with regard to FIG. 6. Each of the plug bores 504 is a blind plug bore 504 (closed at one end) and receives a biasing member 704 and a plug 506. Each plug bore 504 is aligned coaxially with one of the inlet apertures 404 such that the biasing member 704 operates to bias the plug 506 toward a closed position in which the plug 506 contacts a plug seat 708 formed as part of the seat 310. In the closed position, each plug 506 closes the inlet aperture 404 with which it is aligned, thereby inhibiting flow through the seat 310. Each plug 506 is further movable from the closed position to an open position in which the plug 506 is retracted from the plug seat 708 and flow can pass through the inlet apertures 404 and through the outlet apertures 502 to enter the compression space 108.

The manifold plate 312 includes a control space 508, a control seat 706, and a control opening 510 formed as part of the manifold plate 312. In preferred constructions, these features are formed as part of a one-piece or unitary manifold plate 312 and cannot be separated without destroying the manifold plate 312. Due to the preferred shape of these features, the most viable method of forming the manifold plate 312 is an additive manufacturing process. Conventional manufacturing processes are generally not capable of forming the desired shapes of these features, with the desired surface finishes, and in particular are not capable of forming the control space 508.

The control opening 510 provides for fluid communication between the compression space 108 and the control space 508. The control seat 706 is positioned such that the control member 308 is movable into a position that blocks fluid communication between the compression space 108 and the control space 508 such that the control space 508 is effectively sealed and isolated. Thus, when the control member 308 moves to the second position and isolates the control space 508, the pressure within the control space 508 becomes fixed at whatever point it was at just prior to the movement of the control member 308 into the second position.

Figure 8:
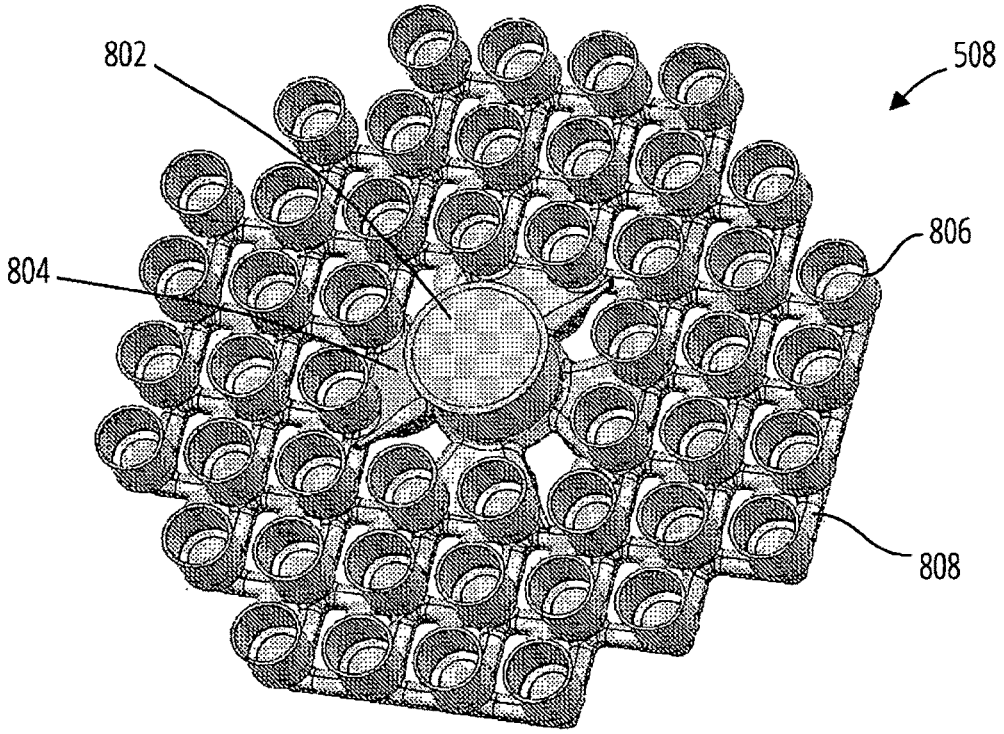
FIG. 8 is a perspective view of the various spaces that define a control space formed in the manifold plate of FIG. 6.

FIG. 8 is a reverse image of a portion of the manifold plate 312 such that the spaces that define the control space 508 are shown as solid and the solid areas are removed. As can be seen, the control seat 402 and the control opening 510 define a large control chamber 802 that is capable of receiving fluid. Four distribution channels 804 connect the control chamber 802 to a series of runners 808 that interconnect each of the plug bores 504 to the control space 508 such that a plug space 806 is in fluid communication with the control space 508.

Figure 5:
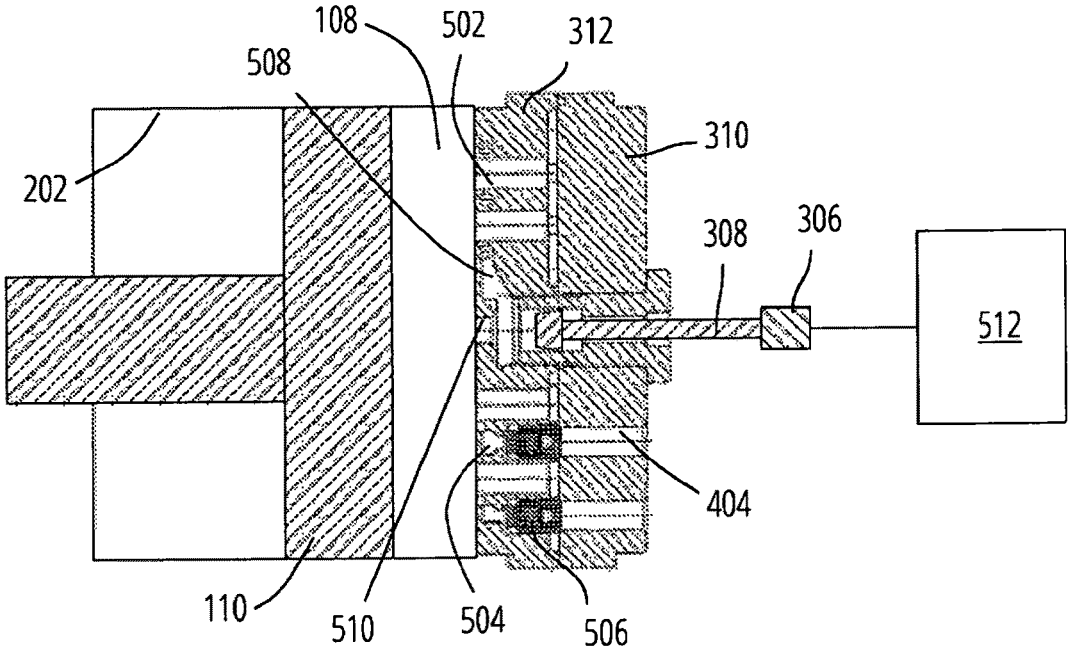
FIG. 5 is a schematic illustration of a portion of the reciprocating gas compressor and the unloader valve of FIG. 4.

To operate the construction of FIG. 7 and FIG. 8, the unloader valve 300 is first assembled into a reciprocating gas compressor 100 as is schematically illustrated in FIG. 5. Specifically, the manifold plate 312 is in fluid communication with the compression space 108 and the seat 310 is positioned in fluid communication with a source of gas to be compressed. The actuator 306 is coupled to a controller 512 that operates to move the control member 308 between the first position and the second position. In some constructions a digital control such as a programmable logic controller (PLC) is employed to drive an electronic actuator 306 that ultimately moves the control member 308.

With the control member 308 in the first position (shown in FIG. 5), the control space 508 is exposed to the compression space 108 which acts as a pressure source. As the piston 110 retracts (note that the piston 110 is shown rotated 90 degrees as compared to the piston of FIG. 1), the compression space 108 becomes larger and the pressure drops. When the pressure within the control space 508 reaches a predetermined point, the biasing force of the biasing members 704 is overcome and the plugs 506 are pulled into an open position. As gas to be compressed flows into the compression space 108, the pressure could increase which would allow the biasing members 704 to return the plugs 506 to a closed position. To stop this, once the plugs 506 move to the open position, the control member 308 is moved via the controller 512 and the actuator 306 to the second position to seal and isolate the control space 508. This effectively holds the plugs 506 in the open position regardless of the pressure within the compression space 108. At some point just before, as, or just after the piston 110 begins its compression stroke, the controller 512 moves the control member 308 back to the first position and the control space 508 fills with higher pressure gas which allows the plugs 506 to return to the closed position during the compression stroke. This process is repeated with each rotational cycle and for each individual inlet/outlet bore 202 and unloader valve 300 to compress the gas as desired.

FIG. 9 through FIG. 12 illustrate an alternative construction of an unloader valve 900. The unloader valve 900 includes a manifold plate 902, an interface plate 910, a control seat 904, and a seat 310 that is very similar to the prior described seat 310. The manifold plate 902 includes a plurality of outlet apertures 502 similar to those described earlier. In addition, the manifold plate 902 includes a series of attachment apertures 1106 (best illustrated in FIG. 11) that are threaded to receive one of a plurality of valve cups 908.

The control seat 904 is similar to the control seat 402 and attaches to and retains the seat 310 and the manifold plate 902 as previously described. The control seat 904 includes one or more control passages 906 that are arranged to selectively provide fluid communication between the control opening 510 and a control space 912.

The control space 912 is formed between the manifold plate 902 and the interface plate 910. The interface plate 910, better illustrated in FIG. 10 engages the manifold plate 902 and is held in place by the plurality of valve cups 908 that are threaded into the manifold plate 902 with the interface plate 910 sandwiched therebetween. The manifold plate 902 and the interface plate 910 define spaces that correspond with the valve cups 908 such that fluid can enter the valve cups 908 via cup holes 1102 formed therein and positioned in the control space 912 between the manifold plate 902 and the interface plate 910.

Figure 10:
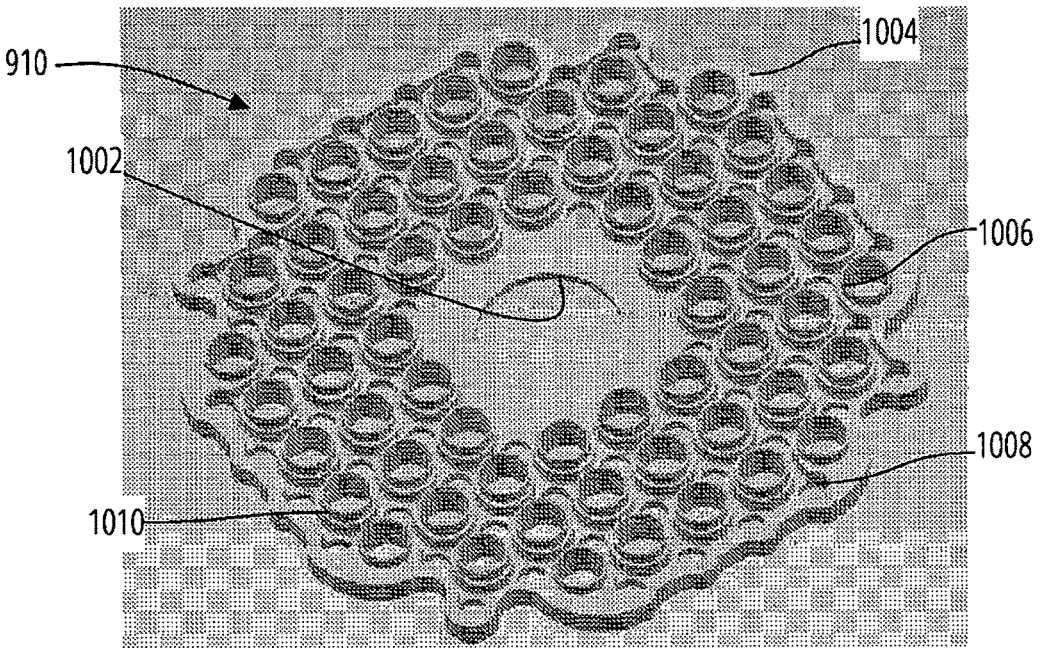
FIG. 10 is a perspective view of an interface plate suitable for use with the unloader valve of FIG. 9.

As illustrated in FIG. 10, the interface plate 910 includes a plate portion 1004, a central bore 1002, a series of cup openings 1006, and a series of outlet bores 1008. The plate portion 1004 is substantially planar and is shaped to fit within the manifold plate 902. The central bore 1002 is formed at or near the center of the plate portion 1004 and is sized to allow for the passage of the control seat 904 therethrough.

The outlet bores 1008 are bores that pass through the plate portion 1004. The outlet bores 1008 could include threads that are sized and arranged to threadably receive the valve cups 908. Alternatively, the outlet bores 1008 are through bores and the attachment apertures 1106 in the manifold plate 902 are threaded. The outlet bores 1008 are arranged in a series of rows and columns that extend around the central bore 1002.

The cup openings 1006 are through bores that extend through the plate portion 1004 and that each include a wall portion 1010 that surrounds the cup opening 1006 and extends away from the plate portion 1004 in a direction away from the manifold plate 902. The cup openings 1006 are arranged in a series of rows and columns that extend around the central bore 1002.

While FIG. 10 illustrates the rows of cup openings 1006 and the rows of outlet bores 1008 arranged in an alternating fashion, other arrangements such as rows and columns that include both cup openings 1006 and outlet bores 1008 could be employed. The arrangement of the cup openings 1006 and the outlet bores 1008 should not limit the invention in any way.

Figure 9:
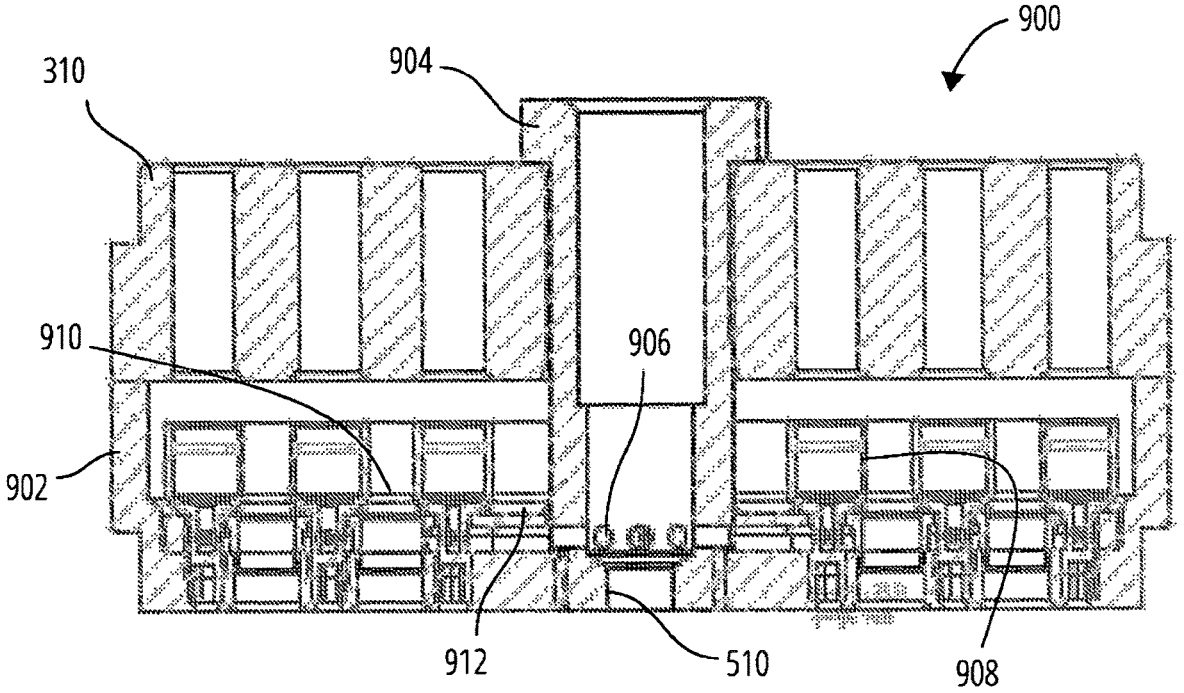
FIG. 9 is a cross-sectional view of another unloader valve taken through a centerline of the unloader valve.
Figure 11:
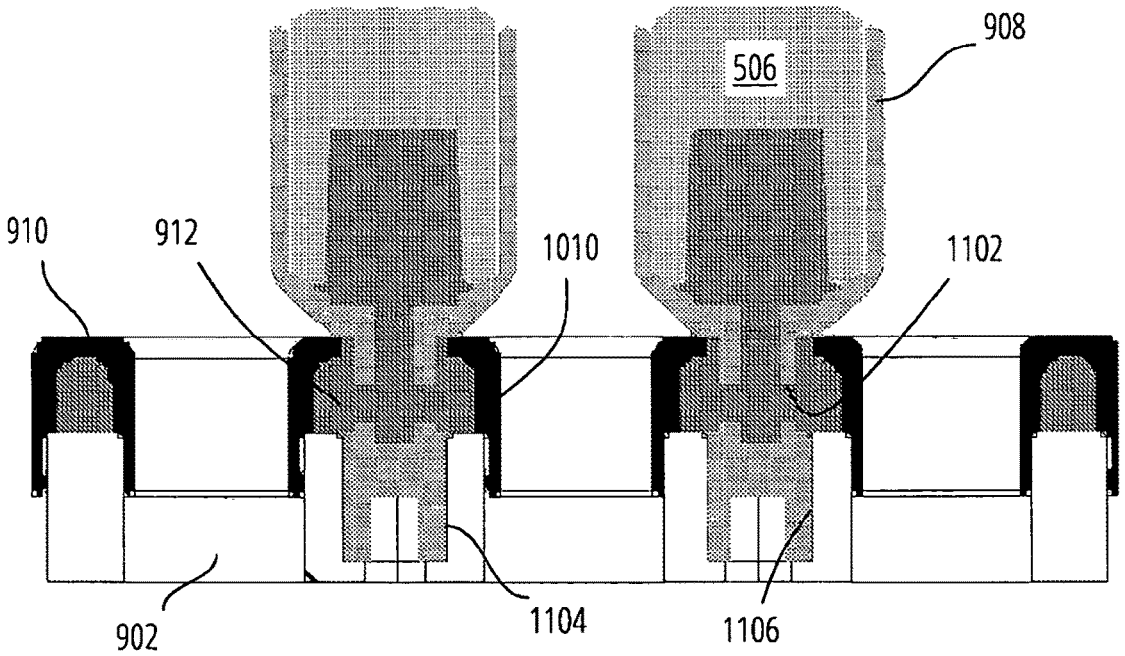
FIG. 11 is an enlarged view of a portion of the unloader valve of FIG. 10 including an attachable valve cup.

FIG. 11 is an enlarged section view of a portion of the unloader valve 900 of FIG. 9. The interface plate 910 is positioned on the inner surface of the manifold plate 902 to define the control space 912 that includes the spaces between the wall portions 1010 and the manifold plate 902. Each of the valve cups 908 includes a threaded cup stem 1104 that threadably engages one of the cup openings 1006. As the valve cup 908 is installed, it eventually contacts the wall portion 1010 surrounding its respective cup opening 1006 to form a seal between the valve cup 908 and the wall portion 1010. Each cup stem 1104 includes one or more cup holes 1102 that provide fluid communication between the control space 912 and the interior of the valve cup 908. Each valve cup 908 contains a plug 506 that seals the control space 912 behind the plug 506. Thus, the valve cups 908, the interface plate 910, and the manifold plate 902 cooperate to fully enclose the control space 912 with the only opening, the control opening 510 being selectively opened or closed by the control member 308.

The unloader valve 900 operates in much the same way as the unloader valve 300 with the main difference being in how the control space 912 is formed and shaped.

Figure 12:
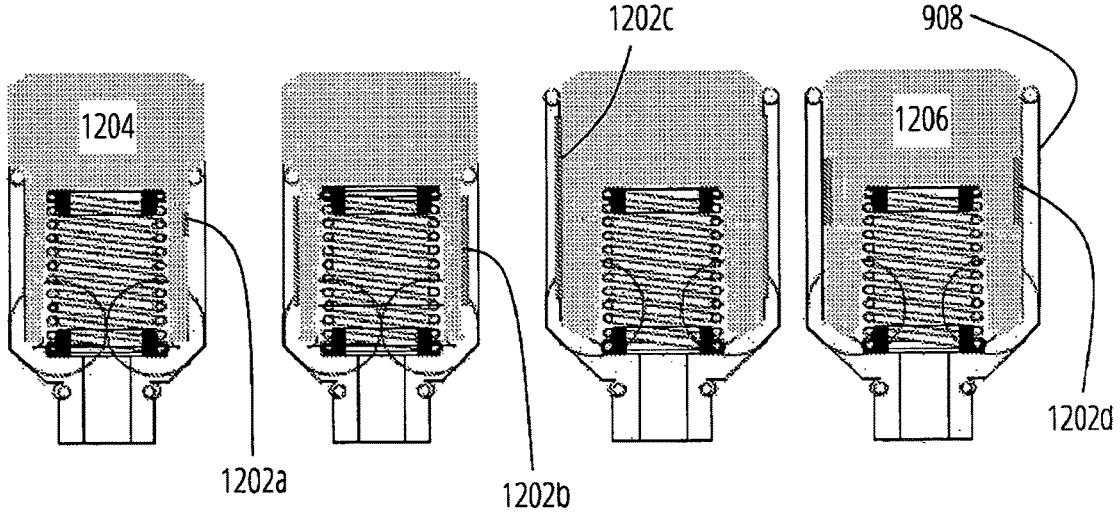
FIG. 12 illustrates several arrangements of a seal positioned between the attachable valve cup of FIG. 11 and a plug.

As illustrated in FIG. 12, a seal can be formed between a mushroom plug 1204 or a cylindrical plug 1206 and the valve cups 908 to reduce the likelihood of unwanted leakage. FIG. 12 illustrates alternatives for forming this seal with the two different shaped plugs. The first two images include a mushroom plug 1204 that includes a cylindrical body that moves within the valve cup 908 and an enlarged cylindrical head. This arrangement allows for the use of a smaller diameter valve cup 908 with a larger head. The next two images include a uniform cylindrical plug 1206 that moves within the valve cup 908.

A first seal member 1202*a* is positioned within a seal groove formed in the mushroom plug 1204. The first seal member 1202*a* is relatively short when compared to the length of the plug 506 within the valve cup 908. The first seal member 1202*a* could be formed from a resilient material such as rubber, or a more rigid material such as TEFLON, brass, or bronze with these more rigid materials also enhancing the ability of the plug 506 to slide within the valve cup 908. A fourth seal member 1202*d* is similar to the first seal member 1202*a* but is applied to the cylindrical plug 1206 rather than the mushroom plug 1204.

A second seal member 1202*b* is positioned within a seal groove formed in the valve cup 908 rather than in the mushroom plug 1204 or the cylindrical plug 1206. The second seal member 1202*b* is much longer than the first seal member 1202*a* but can be made using the same materials as the first seal member 1202*a* if desired. A third seal member 1202*c* is similar to the second seal member 1202*b* but is applied to the valve cup 908 for use with a cylindrical plug 1206 rather than the mushroom plug 1204.

Figure 13:
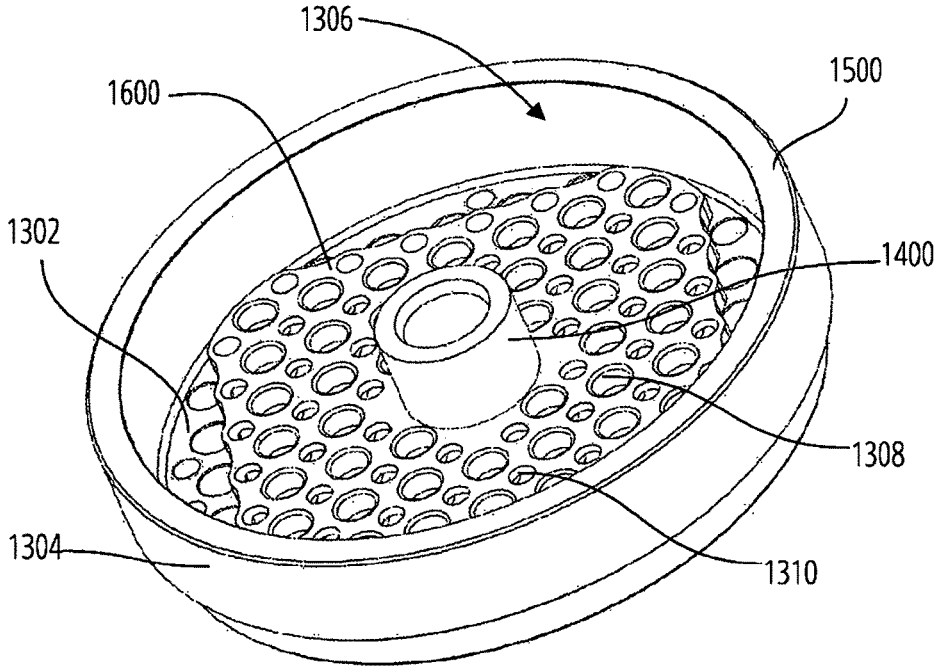
FIG. 13 is a perspective view of another arrangement of a portion of an unloader valve.

FIG. 13 illustrates an alternative arrangement of a manifold plate 1500 and interface plate 1600 suitable for use with any of the prior embodiments described that employ an interface plate. The manifold plate 1500 includes a manifold base 1302 that is surrounded by a manifold wall 1304 to define a manifold interior 1306. The interface plate 1600 is positioned on top of and in direct contact with the manifold base 1302. A valve cylinder 1400 is positioned on top of the interface plate 1600 such that it too is disposed within the manifold interior 1306 and so that a portion of the interface plate 1600 is sandwiched between the manifold plate 1500 and the valve cylinder 1400.

Each of the manifold plate 1500 and the interface plate 1600 includes a number of plug bores 1308 and a number of outlet apertures 1310 that are aligned with one another when the interface plate 1600 is positioned within the manifold interior 1306. The plug bores 1308 and the outlet apertures 1310 can be arranged in any pattern desired, including those arrangements already described.

Figure 14:
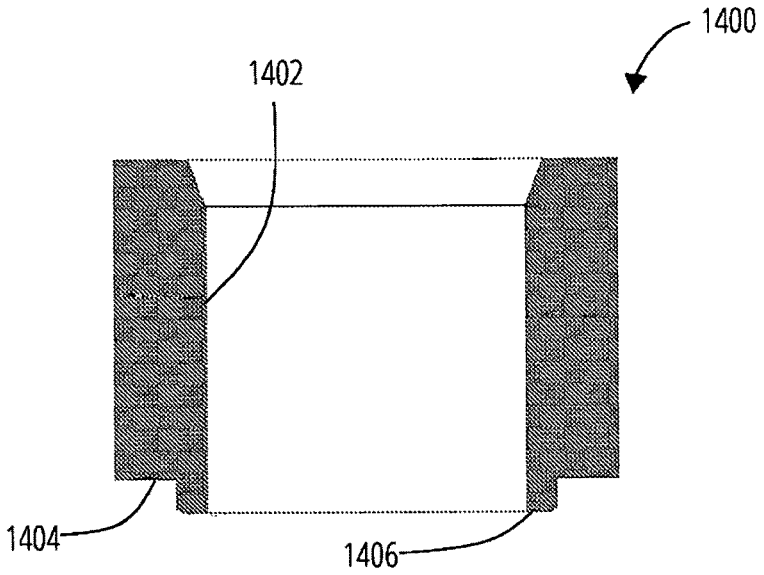
FIG. 14 is a section view of a valve cylinder of the arrangement of FIG. 13.

The valve cylinder 1400, illustrated in FIG. 14 is a cylindrical component having an annular cross-section that defines a central bore 1402. A first end of the valve cylinder 1400 includes a shoulder 1404 and an extension 1406 that are arranged to sandwich the interface plate 1600 between the manifold plate 1500 and the valve cylinder 1400 as will be described in greater detail with regard to FIG. 17

Figure 15:
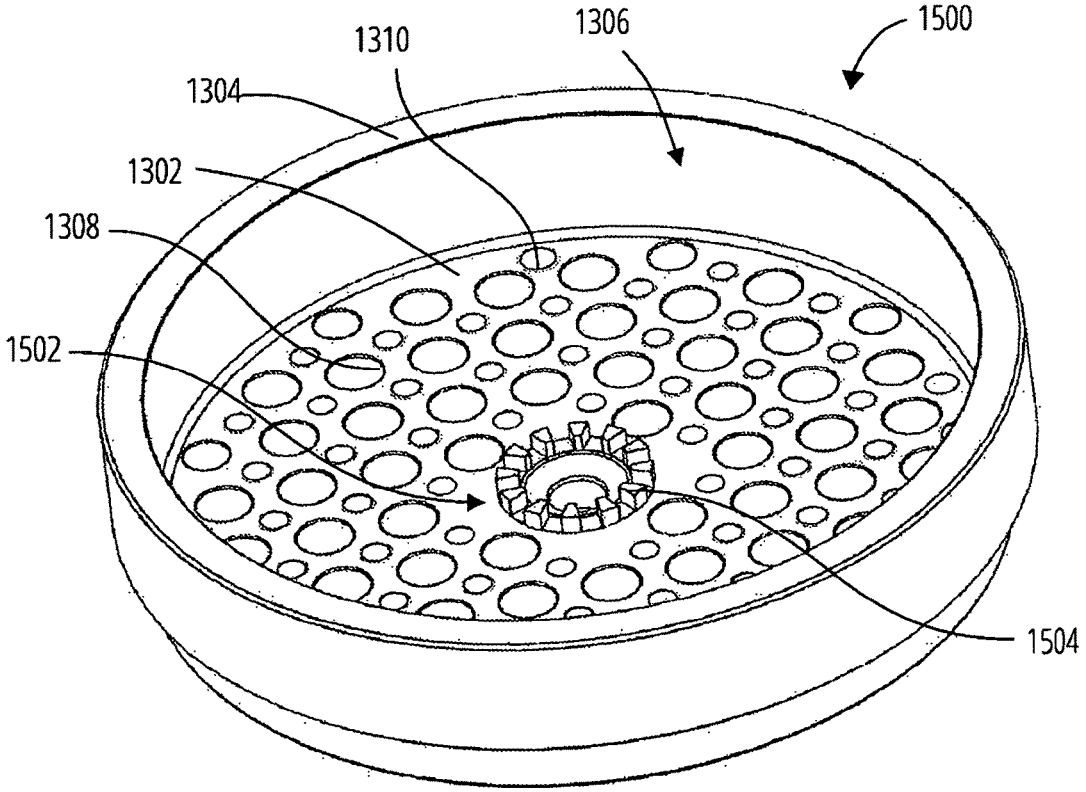
FIG. 15 is a perspective view of a manifold plate of the arrangement of FIG. 13.

Turning to FIG. 15, the manifold interior 1306 is illustrated with the valve cylinder 1400 and the interface plate 1600 removed. As illustrated, the manifold base 1302 includes a number of plug bores 1308 and a number of outlet apertures 1310 arranged in a pattern that matches the pattern of the interface plate 1600 to assure the desired level of alignment. The number of plug bores 1308 and the number of outlet apertures 1310 need not exactly match the quantity in the interface plate 1600. However, in preferred embodiments, the number of plug bores 1308 in the manifold base 1302 matches the number of plug bores 1308 in the interface plate 1600.

A castellated spacer 1502 is positioned at the center of the manifold plate 1500 within the manifold interior 1306. In the illustrated construction, the castellated spacer 1502 is formed as a single component with the manifold plate 1500 and includes a number of wedge bosses 1504 that extend from the manifold base 1302. The wedge bosses 1504 are wedge-shaped bosses that are positioned in a circular pattern in a manner that defines gaps between the individual wedge bosses 1504. The wedge bosses 1504 are arranged to define an inner diameter that is sized to receive the extension 1406 of the valve cylinder 1400 adjacent the shoulder 1404 as will be described with regard to FIG. 17. The term "castellated" refers to the appearance of the castellated spacer 1502 which includes alternating high features (wedge bosses 1504) with alternating low spaces (the gaps) therebetween.

Figure 16:
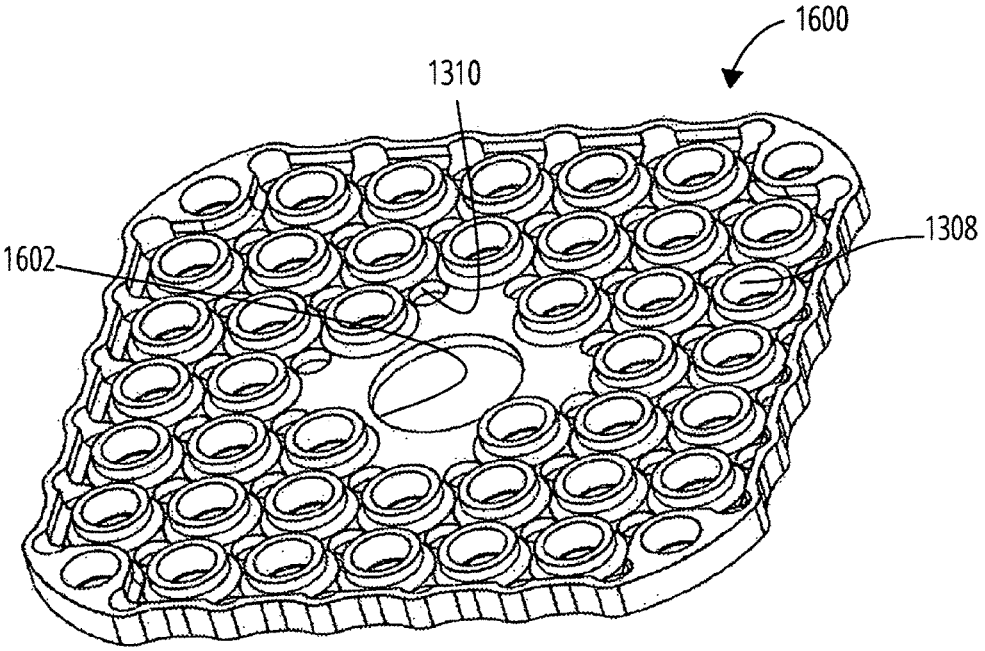
FIG. 16 is a perspective view of an interface plate of the arrangement of FIG. 13.

FIG. 16 illustrates the contact side of the interface plate 1600 in greater detail. Each of the plug bores 1308 is defined by a wall that contacts the manifold base 1302. The walls also cooperate to form a control space between the manifold base 1302 and the interface plate 1600 to allow for a flow of fluid. A plate bore 1602 is formed in the interface plate 1600 and is sized to receive the extension 1406 of the valve cylinder 1400 as will be described with reference to FIG. 17.

Figure 17:
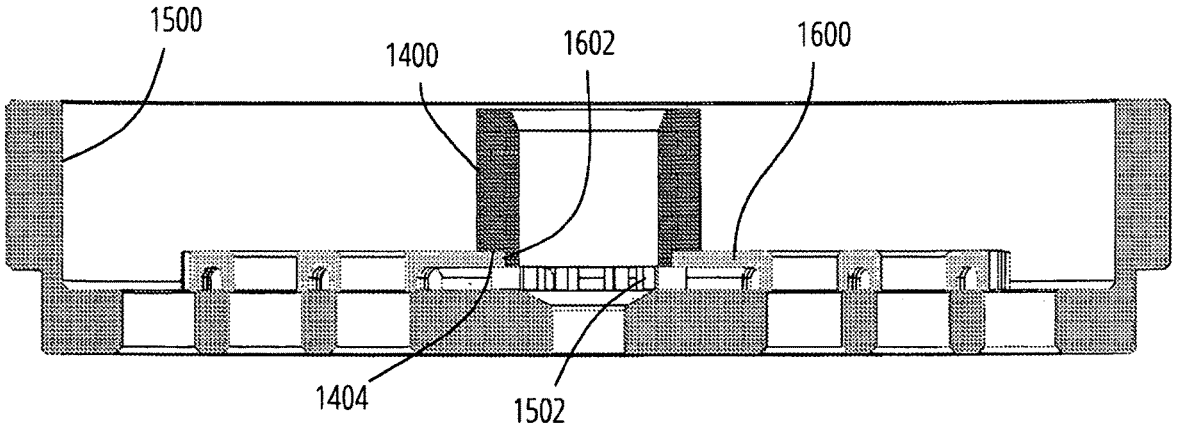
FIG. 17 is a section view of the arrangement of FIG. 13 taken through a centerline of the manifold plate.

FIG. 17 is a cross-section of the valve cylinder 1400, manifold plate 1500, and the interface plate 1600 in the assembled or operating position. As illustrated, the interface plate 1600 is positioned on the manifold base 1302 with each of the plug bores 1308 of the manifold plate 1500 aligned with a corresponding plug bore 1308 of the interface plate 1600.

The plate bore 1602 is sized such that a portion of the interface plate 1600 rests on the castellated spacer 1502 and specifically contacts each of the wedge bosses 1504. However, the plate bore 1602 has a larger diameter then the inner diameter of the castellated spacer 1502 such that a portion of each of the wedge bosses 1504 remains uncovered when the interface plate 1600 is in place.

The valve cylinder 1400 is positioned on top of the interface plate 1600 such that the shoulder 1404 contacts the interface plate 1600 and the extension 1406 defined by the shoulder 1404 contacts the exposed portions of the wedge bosses 1504. The valve cylinder 1400 can be biased or pushed toward the manifold base 1302 to sandwich the interface plate 1600 between the shoulder 1404 and the wedge bosses 1504. With this arrangement, the shoulder 1404 and the interface plate 1600 cooperate to define a seal therebetween. In addition, the interface plate 1600 is held in place due to its contact with the shoulder 1404 and the wedge bosses 1504. However, there is no seal formed between the castellated spacer 1502 and the interface plate 1600 due to the gaps between the wedge bosses 1504. This arrangement provides a flow path into the control space formed between the interface plate 1600 and the manifold plate 1500. The control space functions much like the control spaces 508, 912 previously described.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope. The scope of patented subject matter is defined only by the allowed claims. Moreover, none of these claims are intended to invoke a means plus function claim construction unless the exact words "means for" are followed by a participle.

What is claimed is:

1. An unloader valve comprising:

a seat including a plurality of inlet apertures, each inlet aperture spaced apart from the other inlet apertures and extending through the seat along one of a plurality of parallel inlet axes;

a manifold plate fixedly connected to the seat, the manifold plate including a plurality of outlet apertures, each outlet aperture spaced apart from the other outlet apertures and extending through the manifold plate along one of a plurality of parallel outlet axes;

a plurality of blind plug holes, each blind plug hole centrally aligned along one of the inlet axis of the plurality of parallel inlet axes;

a control chamber formed in the manifold plate; and a control space defined by the manifold plate and arranged to fluidly connect the control chamber and each of the blind plug holes to one another;

a control member disposed within the control chamber and movable between a first position in which the control space is exposed to a pressure source, and a second position in which the control space is isolated; and a plurality of plugs, each plug positioned within one of the blind plug holes and movable between a closed position in which each plug closes one of the inlet apertures and an open position in which the plurality of inlet openings are in fluid communication with the plurality of outlet openings.

2. The unloader valve of claim 1, wherein each of the plugs moves from the closed position to the open position in response to the control member being positioned in the first position and a pressure of the pressure source being below a predetermined pressure.

3. The unloader valve of claim 2, wherein each of the plugs remains in the open position in response to movement of control member from the first position to the second position.

4. The unloader valve of claim 1, further comprising a plurality of biasing members, each biasing member positioned within one of the blind plug holes and operable to bias one of the plugs toward the closed position.

5. The unloader valve of claim 1, wherein the manifold plate is a single unified component that cannot be separated without destroying the manifold plate.

6. The unloader valve of claim 5, wherein the manifold plate is formed using an additive manufacturing process.

7. The unloader valve of claim 1, wherein the control chamber is formed in a center of the manifold plate and wherein the plurality of outlet apertures and the plurality of blind plug holes are arranged around all sides of the control chamber.

8. The unloader valve of claim 7, wherein the plurality of outlet apertures and the plurality of blind plug holes are arranged in a series of rows and columns.

9. The unloader valve of claim 7, wherein the plurality of outlet apertures and the plurality of blind plug holes are arranged in an alternating pattern.

10. An unloader valve for use with a reciprocating gas compressor having a compression space defined by a piston and a cylinder, the unloader valve comprising:

a seat including a plurality of inlet apertures;

a manifold plate fixedly connected to the seat, the manifold plate including a plurality of outlet apertures, a plurality of plug holes;

a control chamber formed in the manifold plate; and a control space fully defined by the manifold plate and arranged to fluidly connect the control chamber and each of the plug holes to one another;

a control member disposed within the control chamber and movable between a first position in which the control space is exposed to the compression space, and a second position in which the control space is isolated from the compression space; and a plurality of plugs, each plug positioned within one of the plug holes, each plug movable from a closed position in which each plug closes one of the inlet apertures to an open position in response to the control member being disposed in the first position and a pressure within the control space being below a predetermined pressure, and wherein each plug is maintained in the open position in response to the control member being in the second position.

11. The unloader valve of claim 1, further comprising a plurality of biasing members, each biasing member positioned within one of the plug holes and operable to bias one of the plugs toward the closed position.

12. The unloader valve of claim 1, wherein the manifold plate is a single unified component that cannot be separated without destroying the manifold plate.

13. The unloader valve of claim 12, wherein the manifold plate is formed using an additive manufacturing process.

14. The unloader valve of claim 1, wherein the control chamber is formed in a center of the manifold plate and wherein the plurality of outlet apertures and the plurality of plug holes are arranged around all sides of the control chamber.

15. The unloader valve of claim 14, wherein the plurality of outlet apertures and the plurality of plug holes are arranged in a series of rows and columns.

16. The unloader valve of claim 14, wherein the plurality of outlet apertures and the plurality of plug holes are arranged in an alternating pattern.

17. An unloader valve for use with a reciprocating gas compressor having a compression space defined by a piston and a cylinder, the unloader valve comprising:

a seat including a plurality of inlet apertures;

a manifold plate including a plurality of outlet apertures and a plurality of attachment apertures;

a control seat threadably coupled to the manifold plate to fixedly attach the seat and the manifold plate;

an interface plate positioned between the seat and the manifold plate and cooperating with the manifold plate to define a control space;

a plurality of valve cups, each valve cup threadably connected to the manifold plate and operable to sandwich the interface plate between the valve cups and the manifold plate;

a control member disposed within the control seat and movable between a first position in which the control space is exposed to the compression space, and a second position in which the control space is isolated from the compression space; and a plurality of plugs, each plug positioned within one of the valve cups, each plug movable from a closed position in which each plug closes one of the inlet apertures to an open position in response to the control member being disposed in the first position and a pressure within the control space being below a predetermined pressure, and wherein each plug is maintained in the open position in response to the control member being in the second position.

18. The unloader valve of claim 17, wherein each of the plugs moves from the closed position to the open position in response to the control member being positioned in the first position and a pressure of the pressure source being below a predetermined pressure.

19. The unloader valve of claim 17, wherein each of the plugs remains in the open position in response to movement of control member from the first position to the second position.

20. The unloader valve of claim 17, further comprising a plurality of biasing members, each biasing member positioned within one of the valve cups and operable to bias one of the plugs toward the closed position.

21. The unloader valve of claim 17, further comprising a castellated spacer formed as part of the manifold plate, the interface plate in direct contact with the castellated spacer.

* * * * *